US007668502B2

(12) United States Patent
Park

(10) Patent No.: US 7,668,502 B2
(45) Date of Patent: Feb. 23, 2010

(54) ADJUSTABLE PAPER CASSETTE

(75) Inventor: Gyeong-ho Park, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 500 days.

(21) Appl. No.: 11/582,997

(22) Filed: Oct. 19, 2006

(65) Prior Publication Data

US 2007/0086819 A1 Apr. 19, 2007

(30) Foreign Application Priority Data

Oct. 19, 2005 (KR) ..... 10-2005-0098725

(51) Int. Cl.
*G03G 15/00* (2006.01)

(52) U.S. Cl. ..... 399/393; 271/147; 271/3.03

(58) Field of Classification Search ..... 399/393; 271/3.03

See application file for complete search history.

(56) References Cited

U.S. PATENT DOCUMENTS 3,366,406 A * 1/1968 Morris ..... 403/107
6,053,493 A * 4/2000 Yokoyama et al. ..... 271/171

FOREIGN PATENT DOCUMENTS

| | | | |
|---|---|---|---|
| JP | 06-064762 | | 3/1994 |
| JP | 2006101362467 | | 5/1996 |
| JP | 09-175662 | | 7/1997 |
| JP | 09-309626 | | 12/1997 |
| JP | 2000313533 | A * | 11/2000 |
| JP | 2001-088948 | | 4/2001 |
| JP | 2002-167083 | | 6/2002 |
| JP | 2003176039 | A * | 6/2003 |
| JP | 2003-312904 | | 11/2003 |
| KR | 10-2003-0080858 | | 10/2003 |
| KR | 10-2003-0093874 | | 12/2003 |

* cited by examiner

*Primary Examiner*—Judy Nguyen
*Assistant Examiner*—Allister Primo
(74) *Attorney, Agent, or Firm*—Roylance, Abrams, Berdo & Goodman, L.L.P.

(57) ABSTRACT

An adjustable paper cassette is provided that may be expanded and contracted by sliding movable frames relative to a base frame and then coupling fixing protrusions to desired fixing holes. Therefore, paper sheets having various sizes may be loaded in the paper cassette, and the size of an image forming apparatus with the paper cassette and the packing size of the image forming apparatus may be reduced without limitation on the size of the paper cassette.

26 Claims, 8 Drawing Sheets

ADJUSTABLE PAPER CASSETTE

CROSS-REFERENCE TO RELATED PATENT APPLICATION

This application claims the benefit under 35 U.S.C. § 119(a) of Korean Patent Application No. 10-2005-0098725, filed on Oct. 19, 2005, in the Korean Intellectual Property Office, the entire disclosure of which is hereby incorporated by reference.

BACKGROUND OF THE INVENTION

1. Field of the Invention

The present invention relates to a paper cassette. More particularly, the present invention relates to a paper cassette that is detachably coupled to an image forming apparatus and is adapted to receive a large number of paper sheets.

2. Description of the Related Art

Examples of image forming apparatuses include a printer, a copying machine, a facsimile, and a multi-function device. An image forming apparatus includes a main body for printing an image and a paper feeder for supplying paper to the main body. Herein, the term "paper" is used to denote all kinds of printing media, such as paper, photographic paper, OHP film, and so forth.

The paper feeder may include a paper cassette detachably coupled to the image forming apparatus in the form of a drawer, a knock-up plate formed in the paper cassette for receiving paper, a knock-up spring urging the knock-up plate toward a pick-up roller for elastically pressing a leading end of the paper against an outer surface of the pick-up roller, a hinge allowing the rotation of the knock-up plate, and a hinge hole receiving the hinge. One end of the knock-up plate is rotatably fixed by the hinge and the hinge hole, and the other end is elastically biased by the knock-up spring. The slope of the knock-up plate is changed by the hinge inserted into the hinge hole according to the number of paper sheets loaded on the knock-up plate. In the image forming apparatus, the pick-up roller is located above the knock-up plate. The pick-up roller makes contact with a leading end of paper loaded on the knock-up plate to supply the paper to the main body of the image forming apparatus one sheet by one sheet. The pick-up roller is coupled to a pick-up roller shaft and is rotated by a pick-up roller driving unit.

The paper feeder can receive sheets of paper having various sizes, such as A6 (105×148 mm), A5 (148×210 mm), B5 (182×257 mm), A4 (210×297 mm), letter (216×297 mm), and legal (216×356 mm). To receive paper of various sizes, the paper cassette of the paper feeder must be larger than the largest paper sheet to be loaded in the paper cassette.

However, the size of the paper cassette should be reduced to provide a smaller image forming apparatus. For example, although the width of an image forming apparatus should be larger than that of A4 paper to print an image on the A4 paper, the length of the image forming apparatus can be smaller than that of the A4 paper. In this case, a paper cassette may protrude from the image forming apparatus when the paper cassette is installed since the paper cassette should be wider and longer than the A4 paper to store the A4 paper. This decreases the cosmetic appearance of the image forming apparatus and increases the package size and installation space of the image forming apparatus.

Accordingly, a need exists for an image forming apparatus having an improved paper cassette.

SUMMARY OF THE INVENTION

The present invention provides a paper cassette adapted to receive paper sheets having various sizes and the use of which reduces the size of an image forming apparatus with the paper cassette and the package size of the image forming apparatus.

According to an aspect of the present invention, a paper cassette includes a base frame detachably coupled to a main body of an image forming apparatus and receiving a leading end of paper. A movable frame is inserted in the base frame and slidable on the base frame by hand. The movable frame receives a trailing end of the paper. A fixing unit fixes the movable frame at a position selected from a plurality of preset fixing positions, wherein the paper cassette is adjustable by a sliding motion of the movable frame.

The fixing unit may have a plurality of fixing holes and a plurality of fixing protrusions that are respectively formed in the bottom surfaces of the base frame and the movable frames for being coupled with each other, and the paper cassette may be adjustable by selectively changing coupling positions between the fixing holes and the fixing protrusions.

The fixing protrusions may be elastically coupled to the fixing holes and releasable from the fixing holes when pressed by hand.

The movable frame may include a first movable frame slidably inserted in the base frame, and a second movable frame slidably inserted in the first movable frame.

The fixing protrusions may include a first fixing protrusion and a second fixing protrusion that are formed on the first movable frame. The first fixing protrusion may determine a fixing position of the first movable frame, and the second fixing protrusion may determine a fixing position of the second movable frame relative to the first movable frame.

The first fixing protrusions may be formed on both sides of the first movable frame in a symmetric manner and may be releasable from the fixing holes when pressed using both hands. The second fixing protrusion may be formed on a center portion of the first movable frame and releasable from the fixing hole when pressed by hand.

The fixing holes may include a plurality of first fixing holes formed in the bottom surface of the base frame and arranged in a sliding direction of the movable frames, and a plurality of second fixing holes formed in a bottom surface of the second movable frame and arranged in the sliding direction of the movable frames. When the first movable frame slides, the first fixing protrusion moves and is elastically coupled to one of the first fixing holes. When the second movable frame slides, the second fixing holes move and one of the second fixing holes is elastically coupled to the second protrusion.

The first fixing holes may be formed along the sliding direction at a position allowing the first movable frame to be fixed in a contracted state, and at a position allowing the first movable frame to be fixed in an expanded state. The second fixing holes may be formed along the sliding direction at a position allowing the second movable frame to be fixed in a contracted state relative to the first movable frame, and at a position allowing the second movable frame to be fixed in an expanded state relative to the first movable frame.

The base frame may include a knock-up plate hinged on a leading end of the base frame for elastically supporting the leading end of the paper, and a pair of side guides connected to each other by a rack and a pinion interlocking with each other. The side guides support both side edges of the paper in front of the knock-up plate. The first fixing holes are formed in the bottom surface of the base frame at a trailing end of the base frame and at a predetermined position allowing the first movable frame to be close to the rack and the pinion but not in contact with the rack and the pinion.

The side guides may include a pawl, and the base frame may further include a ratchet on a bottom surface that engages the pawl. The side guides are freely movable in a direction approaching the side edges of the paper but not freely movable in an opposite direction to the approaching direction.

The second movable frame may include a rear guide supporting the trailing end of the paper. The second fixing holes are formed at a leading end of the second movable frame, and at a position where the second fixing hole is not blocked by the rear guide when the rear guide is maximally moved away from the trailing end of the paper.

The rear guide may include a pawl, and the second movable frame may further include a ratchet on a bottom surface that engages the pawl. The rear guide is freely movable in a direction approaching the trailing end of the paper but not freely movable in an opposite direction to the approaching direction.

The second movable frame may include a frame border portion enclosing the trailing end of the paper, and the base frame may include guide boss rails on both sides for receiving guide bosses formed on both sides of the frame border portion. The guide bosses are movable on the guide rails.

The paper cassette may further include an elastic unit urging the movable frame in an expanding direction.

The elastic unit may be formed on the base frame and may include a push bar elastically pushing the movable frame in the expanding direction and an elastic spring applying an elastic force to the push bar.

According to another aspect of the present invention, a paper cassette includes a base frame detachably coupled to a main body of an image forming apparatus and receiving a leading end of paper, and a first movable frame and a second movable frame that are slidably assembled into the base frame for receiving a trailing end of the paper. The first and second movable frames are selectively fixed at a position from among multiple fixing positions. The first movable frame is inserted in the base frame. The second movable frame is inserted in the first movable frame. The base frame, the first movable frame, and the second movable frame are prevented from interfering with each other when the first and second movable frames slide.

The second movable frame may include a second guide plate protruded on a center portion. The first movable frame may include a guide rail plate in which the second guide plate is slidably inserted. The base frame may include a first slot portion forming a sliding space for the guide rail plate and the second guide plate inserted in the guide rail plate.

The first movable frame may further include first guide plates formed at left and right sides of the guide rail plate. The base frame may further include second slot portions formed at left and right sides of the first slot portion for slidably receiving the first guide plates.

The second movable frame may further include a frame border portion enclosing a trailing end of the paper. The base frame may further include guide boss rails on both sides for receiving guide bosses formed on both sides of the frame border portion. The guide bosses are movable on the guide rails.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

The present invention is described more fully with reference to the accompanying drawings, in which exemplary embodiments of the invention are shown. The invention may, however, be embodied in many different forms and should not be construed as being limited to the exemplary embodiments set forth herein; rather, these exemplary embodiments are provided so that this disclosure is thorough and complete, and fully conveys the concept of the invention to those skilled in the art.

Figure 1:
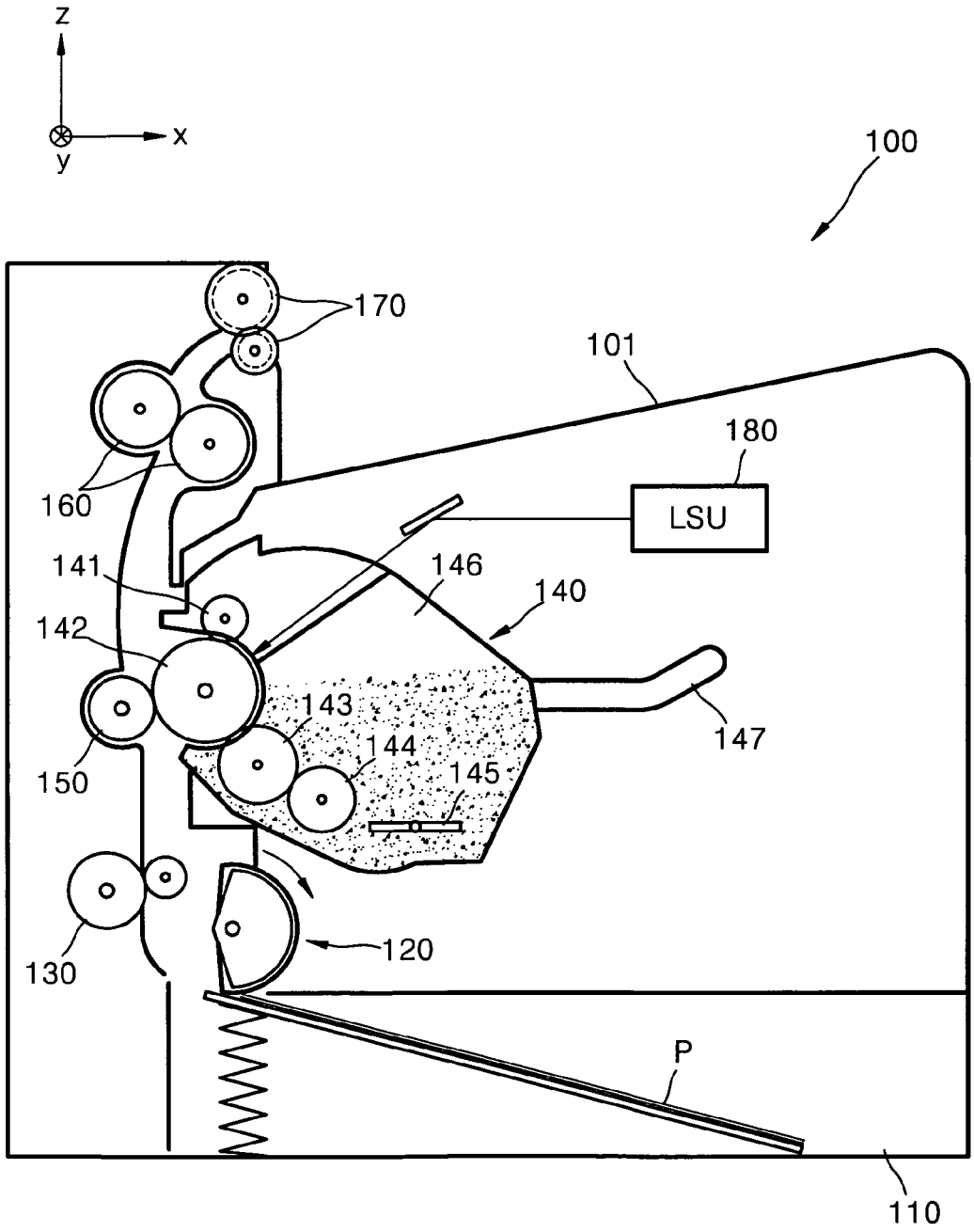
FIG. 1 is a side elevational view in partial cross section of an image forming apparatus with a paper cassette according to an exemplary embodiment of the present invention.

FIG. 1 is an elevational view in partial cross section of an electrophotographic image forming apparatus 100 with a paper cassette 110 according to an exemplary embodiment of the present invention. Referring to FIG. 1, the image forming apparatus 100 includes a main body 101, a development cartridge 140, a light scanning unit (LSU) 180, and the paper cassette 110.

The light scanning unit 180 scans a photoconductor 142 with light corresponding to image data to form an electrostatic latent image on the photoconductor 142. The light scanning unit 180 includes a light source (not shown) emitting a laser beam and a beam deflector (not shown) deflecting the laser beam emitted from the light source.

The development cartridge 140 is detachably mounted on an inner side of the main body 101. In an exemplary embodiment of the present invention, the development cartridge 140 includes a charge roller 141, the photoconductor 142, a developer roller 143, a supply roller 144, an agitator 145, and a toner container 146. Though not shown, the photoconductor 142 and the charge roller 141 may be installed outside of the development cartridge 140. The toner container 146 stores toner. When the toner stored in the toner container 146 is consumed, the development cartridge 140 is replaced with a new one. The development cartridge 140 may be installed in the main body 101 by pushing a handle 147 of the development cartridge 140 in a negative direction of the x-axis. On the contrary, the development cartridge 140 may be detached from the main body 101 by pulling the handle 147 in a positive direction of the x-axis.

The photoconductor 142 is installed to be rotatable in a predetermined direction and is installed so that part of its outer surface is exposed to the outside. The photoconductor 142 includes a cylindrical drum and a photoconductive material layer formed on the cylindrical drum by deposition or the like. The photoconductor 142 is charged by the charge roller 141 to a predetermined potential, and then an electrostatic latent image corresponding to an image to be printed is formed on the photoconductor 142 by light projected from the light scanning unit 180.

Powder toner adheres to the developer roller 143, and the developer roller 143 applies the powder toner onto the electrostatic latent image formed on the photoconductor 142, thereby developing the electrostatic latent image into a toner image. The developer roller 143 receives a developing bias voltage for applying toner to the photoconductor 142. A developing nip is formed between the developer roller 143 and the photoconductor 142 when they contact each other, and a developing gap is formed between the developer roller 143 and the photoconductor 142 when they are spaced apart from each other. The developing nip or the developing gap preferably has a uniform size in an axial direction of the developer roller 143 and the photoconductor 142. As the toner is transferred through the developing nip or the developing gap, developing is performed.

The supply roller 144 supplies toner to the developer roller 143, and the supplied toner adheres to the outer surface of the developer roller 143. The agitator 145 agitates the toner stored in the toner container 146 to substantially prevent the toner from hardening, and the toner is moved toward the supply roller 144 while it is being agitated by the agitator 145.

A transfer roller 150 faces the photoconductor 142 and receives a transfer bias voltage having a polarity opposite to that of the toner image formed on the photoconductor 142, thereby allowing transferring of the toner image from the photoconductor 142 to a paper (P). The toner image is transferred from the photoconductor 142 to the paper (P) by an electrostatic force and a mechanical contact pressure between the photoconductor 142 and the transfer roller 150.

A fuser 160 includes a heat roller and a pressure roller that face each other. The fuser 160 applies pressure and heat to the toner image transferred on the paper (P) to fuse the toner image on the paper (P).

Then, eject rollers 170 eject the paper (P) out the image forming apparatus 100. The ejected paper (P) is stacked on a paper output tray.

A paper traveling passage is as follows. The image forming apparatus 100 includes the paper cassette 110 to receive the paper (P). The pick-up roller 120 draws the paper (P) out of the paper cassette 110 sheet by sheet through rollers 130 and toward the development cartridge 140. When the paper (P) passes between the photoconductor 142 and the transfer roller 150, a toner image is transferred to the paper (P). Next, the paper (P) passes through the fuser 160 where heat and pressure are applied to the toner image to fuse the toner image on the paper (P). Then, the paper (P) is discharged from the image forming apparatus 100 by the eject rollers 170.

Although a black and white electrophotographic image forming apparatus is shown in FIG. 1, the paper cassette of the present invention may be applied to color electrophotographic image forming apparatuses, inkjet image forming apparatuses, and the like.

Figure 2:
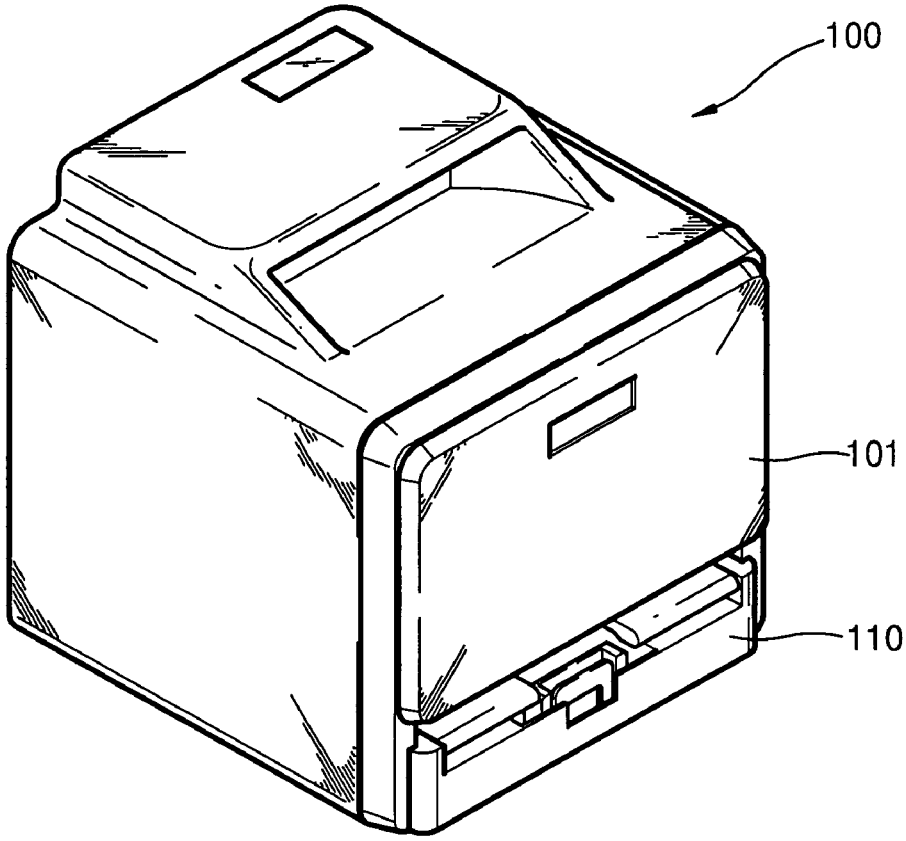
FIG. 2 is a perspective view of the image forming apparatus when the paper cassette is in a fully contracted position according to an exemplary embodiment of the present invention.
Figure 3:
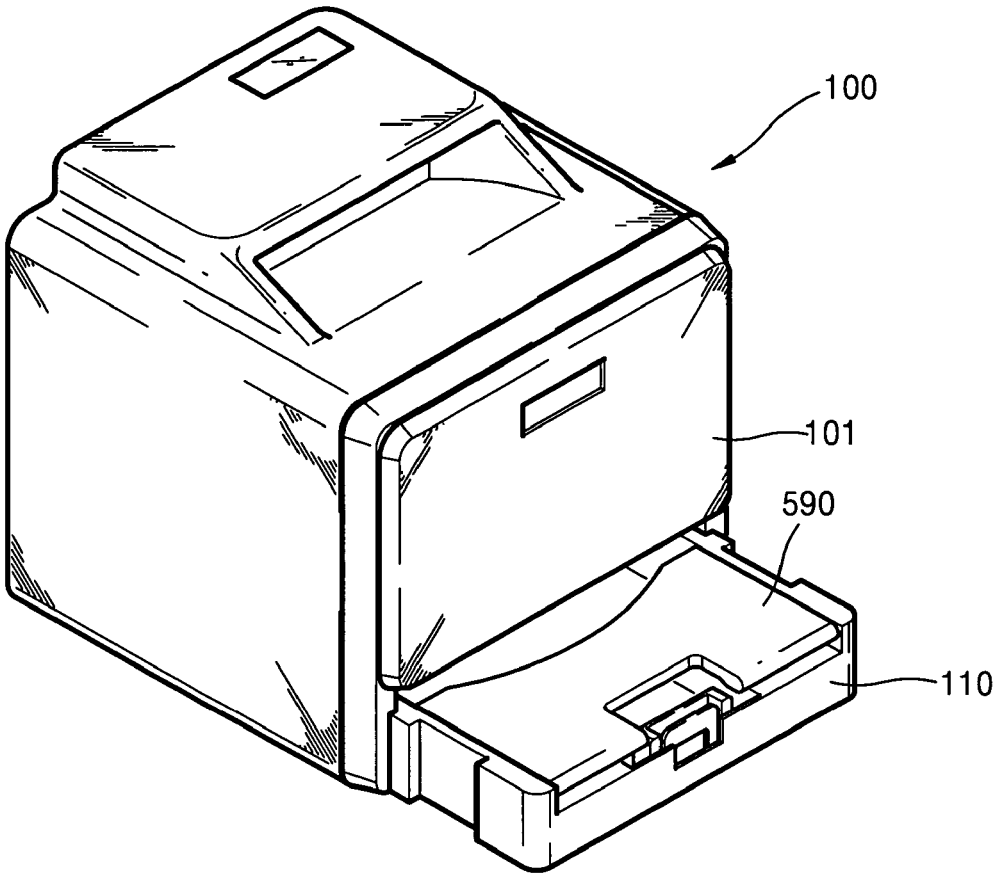
FIG. 3 is a perspective view of the image forming apparatus when the paper cassette is in a fully expanded position according to an exemplary embodiment of the present invention.

FIG. 2 is a perspective view of the image forming apparatus 100 when the paper cassette 110 is in a fully contracted position according to an exemplary embodiment of the present invention. FIG. 3 is a perspective view of the image forming apparatus 100 when the paper cassette 110 is in a fully expanded position according to another exemplary embodiment of the present invention. When the image forming apparatus 100 is shorter than the paper to be used, the paper may be loaded by expanding the paper cassette 110 as shown in FIG. 3. A top portion of the paper cassette 110 is protected by a paper cover 590. The paper cassette 110 receives the paper stably without folding or creasing the paper. In the fully expanded position, the paper cassette 110 partially protrudes from the main body 101 of the image forming apparatus 100. Referring to FIG. 2, when the image forming apparatus 100 is packed for transportation or paper is not loaded in the paper cassette 110, the paper cassette 110 may be contracted, thereby reducing the package size of the image forming apparatus 100 and the space required for installing the image forming apparatus 100.

Figure 4:
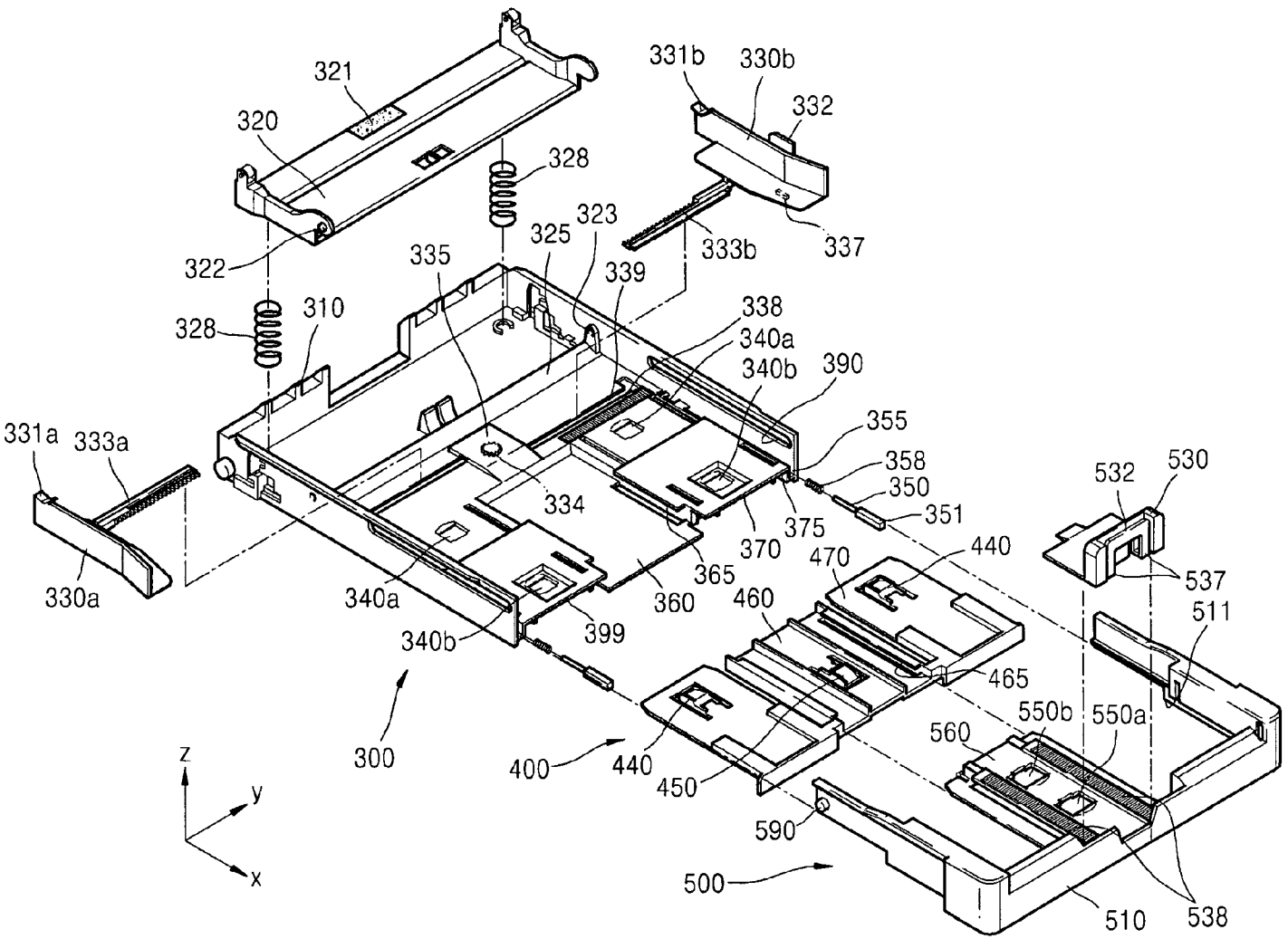
FIG. 4 is an exploded perspective view of the paper cassette according to an exemplary embodiment of the present invention.
Figure 5:
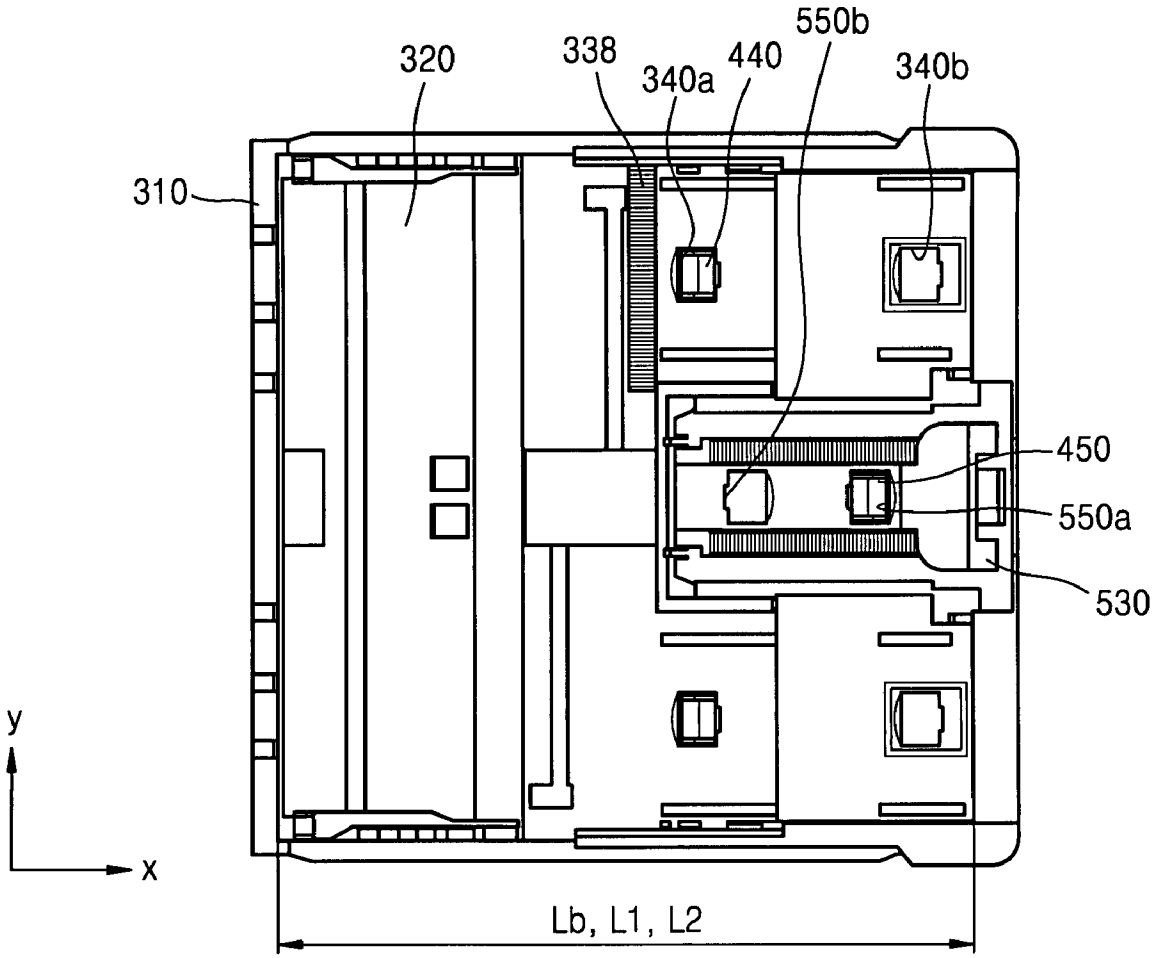
FIG. 5 is a top plan view of the paper cassette when both first and second movable frames are fixed in contracted positions according to an exemplary embodiment of the present invention.
Figure 6:
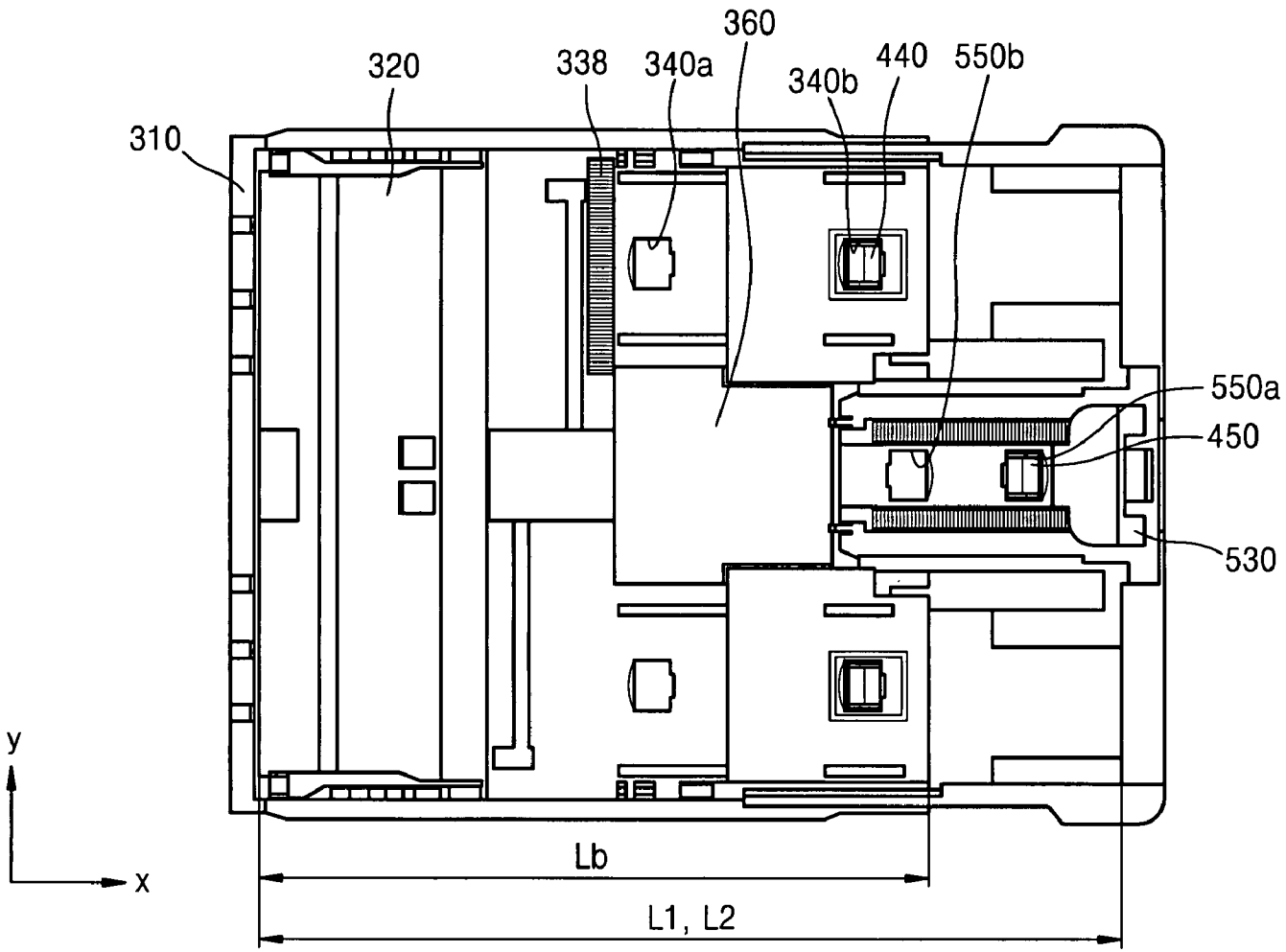
FIG. 6 is a top plan view of the paper cassette when the first movable frame is in an expanded position and the second movable frame is in a contracted position according to an exemplary embodiment of the present invention.
Figure 7:
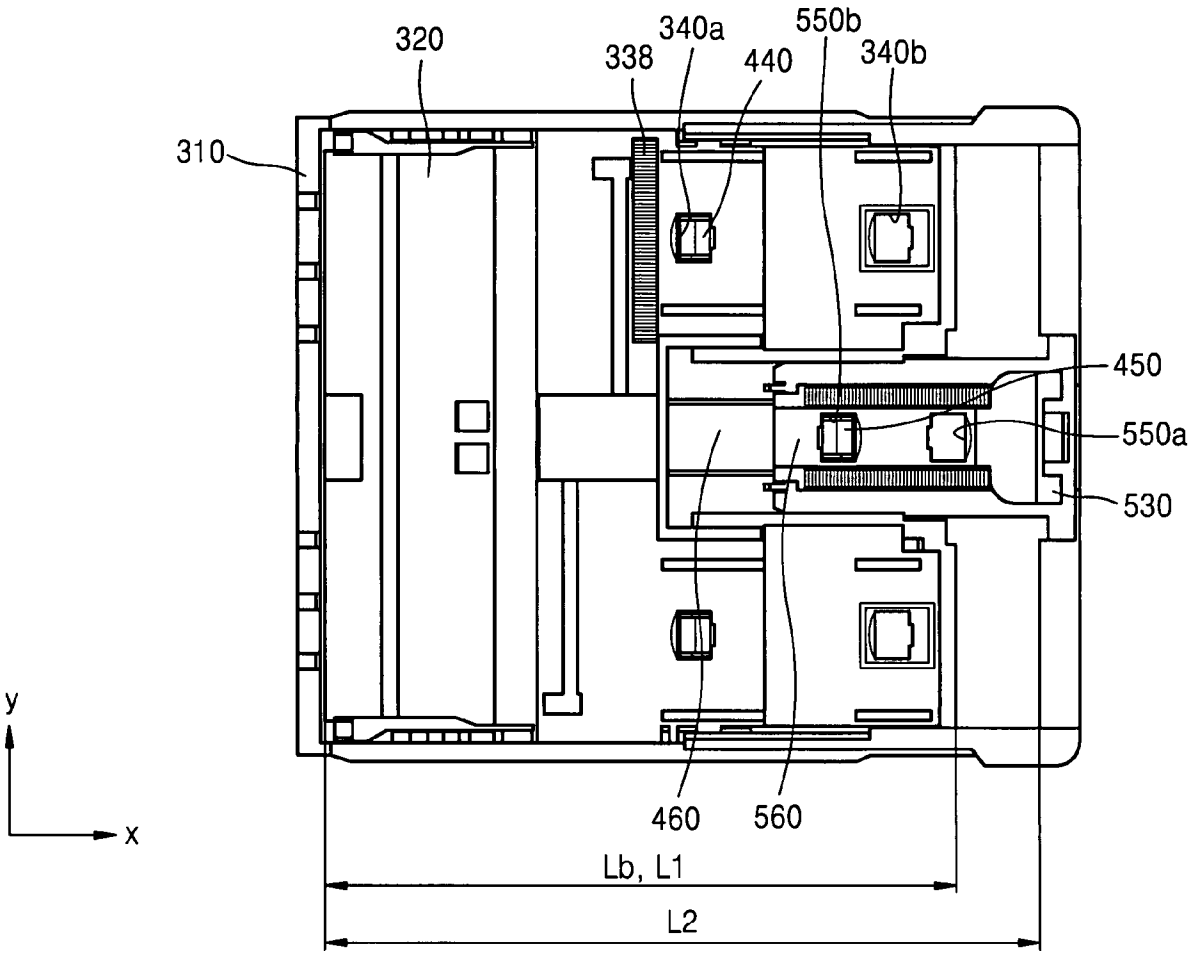
FIG. 7 shows a plan view of the paper cassette when the first movable frame is in a contracted position and the second movable frame is in an expanded position according to an exemplary embodiment of the present invention.
Figure 8:
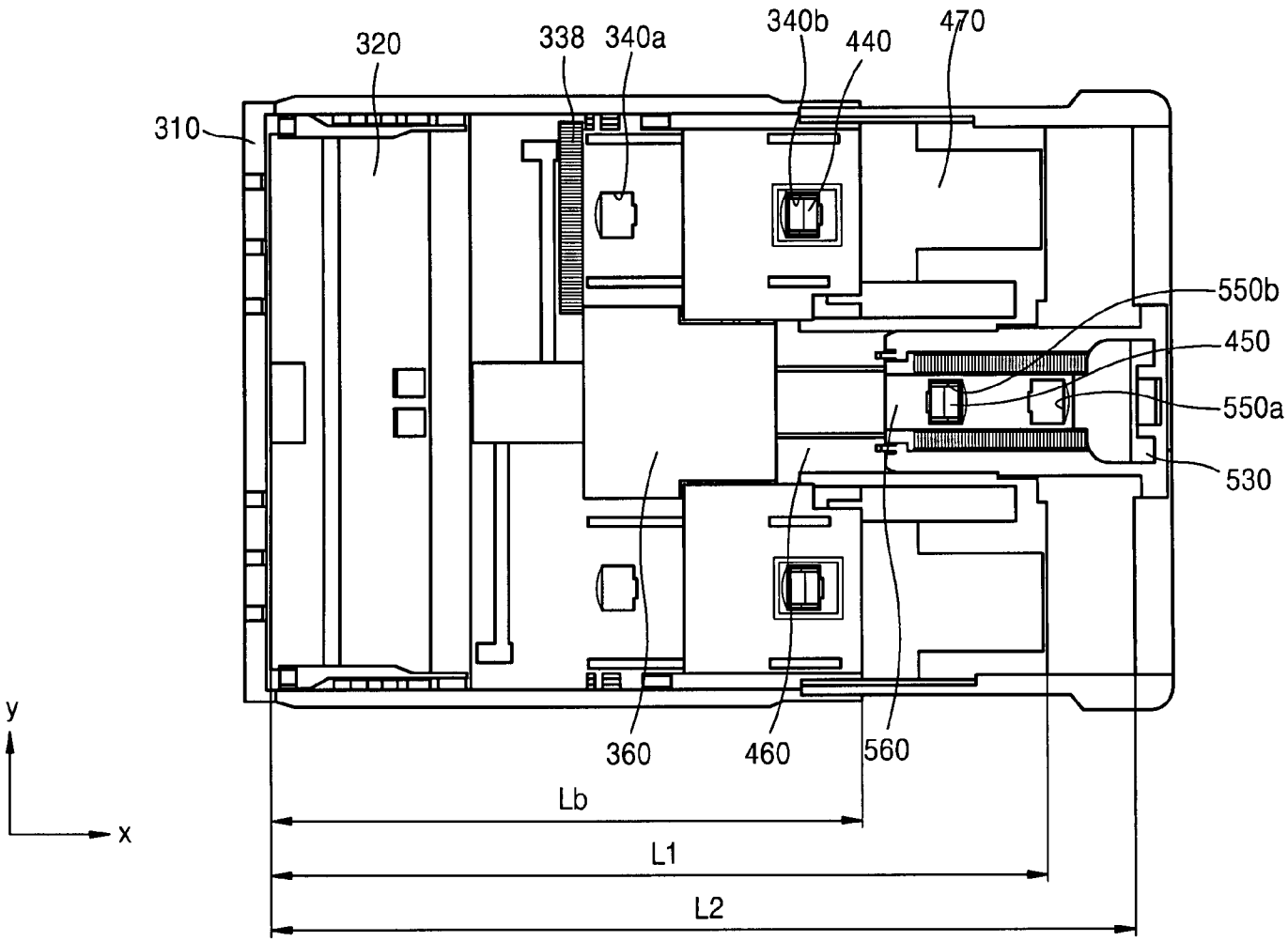
FIG. 8 is a top plan view of the paper cassette when both the first and second movable frames are in expanded positions according to an exemplary embodiment of the present invention.

FIG. 4 is an exploded perspective view of the paper cassette 110 according to an exemplary embodiment of the present invention. FIG. 5 is a top plan view of the paper cassette 110 when both first and second movable frames 400 and 500 are fixed in contracted positions according to an exemplary embodiment of the present invention. FIG. 6 is a top plan view of the paper cassette 110 when the first movable frame 400 is in an expanded position and the second movable frame 500 is in a contracted position according to an exemplary embodiment of the present invention. FIG. 7 is a top plan view of the paper cassette 110 when the first movable frame 400 is in a contracted position and the second movable frame 500 is in an expanded position according to an exemplary embodiment of the present invention. FIG. 8 is a top plan view of the paper cassette 110 when both the first and second movable frames 400 and 500 are in expanded positions according to an exemplary embodiment of the present invention.

Referring to FIGS. 4 through 8, the paper cassette 110 includes a base frame 300, the first and second movable frames 400 and 500, and a fixing unit. The paper cassette 110 may be attached to and detached from the image forming apparatus 100. The paper cassette 110 may be detached from the image forming apparatus 100 for receiving paper, and then it may be attached to the image forming apparatus 100. The paper cassette 110 is an assembly including the base frame 300 and the movable frames 400 and 500. A leading edge of paper is placed at a leading end 310 of the base frame 300, and a trailing edge portion of the paper is placed on the movable frames 400 and 500. The base frame 300 is detachably mounted to the image forming apparatus 100. The movable frames 400 and 500 are slidably assembled to the base frame 300. Although two movable frames are shown, one or more movable frames may be used. The movable frames 400 and 500 are inserted in the base frame 300 and are slidable in the base frame 300 by hand. The leading end 310 of the base frame 300 is where the paper is picked up. A trailing end 399 is where the movable frames 400 and 500 are inserted. A direction from the leading end 310 to the trailing end 399 is defined as a positive direction of the x-axis.

Generally, standard sized paper is loaded in the paper cassette 110. After the length of the paper cassette 110 is adjusted by sliding the movable frames 400 and 500, the movable frames 400 and 500 are fixed by the fixing unit. In an exemplary embodiment of the present invention, the movable frames 400 and 500 are fixed to one of fixing positions that are preset based on desired paper sizes. The fixing position of the movable frames 400 and 500 is selected according to the size of paper to be loaded and other related conditions. The paper cassette 110 is expanded and contracted in the sliding directions of the movable frames 400 and 500.

In an exemplary embodiment of the present invention, the fixing unit includes fixing holes 340*a*, 340*b*, 550*a*, and 550*b* and fixing protrusions 440 and 450 elastically fitted into and released from the fixing holes 340*a*, 340*b*, 550*a*, and 550*b*. To decrease the size of the image forming apparatus 100 and the paper cassette 110, the fixing holes 340*a*, 340*b*, 550*a*, and 550*b* and the fixing protrusions 440 and 450 may be respectively formed in a bottom surface of the base frame 300 or a bottom surface of one of the movable frames 400 and 500. The fixing protrusions 440 and 450 may be coupled to the fixing holes 340*a*, 340*b*, 550*a*, and 550*b* at a desired position by sliding the movable frames 400 and 500. Among various coupling positions between the fixing holes 340*a*, 340*b*, 550*a*, and 550*b* and the fixing protrusions 440 and 450, one coupling position is selected according to the size of paper to be used. Then, the fixing protrusions 440 and 450 are coupled to the fixing holes 340*a*, 340*b*, 550*a*, and 550*b* at the selected coupling position. That is, when the fixing protrusions 440 and 450 are aligned with the fixing holes 340, 340*b*, 550*a*, and 550*b*, the fixing protrusions 440 and 450 elastically inserted into the fixing holes 340*a*, 340*b*, 550*a*, and 550*b*. The fixing protrusions 440 and 450 may be released from the fixing holes 340*a*, 340*b*, 550*a*, and 550*b* by pressing the fixing protrusions 440 and 450 by hand. Alternatively, an actuator (not shown) or a fastener such as a screw (not shown) may be used as the fixing unit according to various exemplary embodiments of the present invention.

In the current exemplary embodiment, the paper cassette 110 includes the first movable frame 400 and the second movable frame 500. However, the paper cassette 110 may include more movable frames. The first movable frame 400 is slidably inserted in the base frame 300, and the second movable frame 500 is slidably inserted in the first movable frame 400. The fixing protrusions 440 and 450 may be formed on the first movable frame 400. The fixing protrusions 440 are denoted as first fixing protrusions, and the fixing protrusion 450 as a second fixing protrusion. The first fixing protrusions 440 determine the position of the first movable frame 400 on the base frame 300. The second fixing protrusion 450 determines the position of the second movable frame 500 on the first movable frame 400.

In the current exemplary embodiment, the paper cassette 110 has the fixing holes 340*a* and 340*b* (that are denoted as first fixing holes) and the fixing holes 550*a* and 550*b* (that are denoted as second fixing holes). However, the paper cassette 110 may have more fixing holes. The first fixing protrusions 440 snap into the first fixing holes 340*a* and 340*b*, and the second protrusion 450 snaps into the second fixing holes 550*a* and 550*b*. Two fixing protrusions may be symmetrically formed on left and right sides of the first movable frame 400, respectively, as the first fixing protrusions 440. In correspondence with the first fixing protrusions 440, the first fixing holes 340*a* and 340*b* may be symmetrically formed in two rows on left and right sides of the base frame 300. The first movable frame 400 connects the base frame 300 and the second movable frame 500 as an intermediate support member. The first fixing protrusions 440, which are symmetrically formed on the left and right sides of the first movable frame 400, securely lock the first movable frame 400 to the base frame 300. The first fixing protrusions 440 may be released from the first fixing holes 340*a* and 340*b* by pressing the first fixing protrusions 440 with both hands.

A single protrusion may be formed on a center portion of the first movable frame 400 as the second fixing protrusion 450. The second fixing protrusion 450 may be released from the second fixing holes 550*a* and 550*b* by pressing the second fixing protrusion 450 by hand. The coupling structure of the first fixing protrusions 440 and the first fixing holes 340*a* and 340*b* is formed on left and right sides of the paper cassette 110, and the coupling structure of the second fixing protrusion 450 and the second fixing holes 550*a* and 550*b* is formed on a center portion of the paper cassette 110. Therefore, the base frame 300, the first movable frame 400, and the second movable frame 500 may be substantially prevented from interfering with one another.

The fixing holes 340*a*, 340*b*, 550*a*, and 550*b* are formed at a plurality of positions along the sliding direction of the first and second movable frames 400 and 500, such that the movable frames 400 and 500 may be locked at various positions according to the sizes of paper to be loaded in the paper cassette 110. A number of holes may be formed in the base frame 300 as the first fixing holes 340*a* and 340*b*, and a number of holes may be formed in the second movable frame 500 as the second fixing holes 550*a* and 550*b*.

When the first movable frame 400 is slid on the base frame 300, the first fixing protrusions 440 of the first movable frame 400 are also moved for elastic coupling with the first fixing holes 340*a* and 340*b* of the base frame 300 at a desired position. When the second movable frame 500 is slid on the first movable frame 400, the second fixing holes 550*a* and 550*b* formed in the second movable frame 500 are also moved, such that one of the second fixing holes 550*a* and 550*b* may be elastically coupled to the second fixing protrusion 450.

The first fixing holes 340*a* and 340*b* may be formed in two positions along the sliding direction (the x-axis direction) of the first movable frame 400. That is, the fixing holes 340*a* are formed at a fully contracting position for locking the first movable frame 400 to the base frame 300 in a fully contracted state, and the fixing holes 340*b* are formed at a fully expanding position for locking the first movable frame 400 to the base frame 300 in a fully expanded state.

Similarly, the second fixing holes 550*a* and 550*b* may be formed at two positions along the sliding direction (the x-axis direction) of the second movable frame 500. That is, the fixing hole 550*a* is formed at a fully contracting position for locking the second movable frame 500 to the first movable frame 400 in a fully contracted state, and the fixing hole 550*b* is formed at a fully expanding position for locking the second movable frame 500 to the first movable frame 400 in a fully expanded state.

The base frame 300 may include a knock-up plate 320 and side guides 330*a* and 330*b*. The knock-up plate 320 has a wide and flat shape for receiving paper thereon. The knock-up plate 320 is elastically biased upwardly by knock-up springs 328. The knock-up plate 320 includes hinge pins 322 formed on one end for coupling with hinge holes 323 formed in the base frame 300. The other end of the knock-up plate 320 is elastically biased by the knock-up springs 328 toward the pick-up roller 120 (see FIG. 1). The knock-up plate 320 rotates upward toward the pick-up roller 120 as the number of paper sheets loaded in the paper cassette 110 reduces.

Referring again to FIG. 1, the pick-up roller 120 is installed in the main body 101 of the image forming system 100. The pick-up roller 120 couples to a pick-up roller shaft and picks up paper (P) one by one whiling being rotated by a pick-up roller driving unit (not shown). The pick-up roller 120 includes a large radial portion that makes contact with the paper (P) and a small radial portion that does not makes contact with the paper (P). The large radial portion of the pick-up roller 120 has a friction coefficient larger than a certain level for picking up the paper (P). A frictional force exerted on a sheet of paper (P) by the large radial portion of the pick-up roller 120 is larger than a frictional force exerted on the sheet of paper (P) by another sheet of paper (P). Therefore, when the large radial portion of the pick-up roller 120 is rotated on the paper (P), only the uppermost sheet of paper (P) is picked up.

A finger member (not shown) may be provided for facilitating the one-by-one picking up of the paper (P). The finger member grasps both sides of a leading end of the paper (P). In this case, only the uppermost sheet of the paper (P) may be released from the finger member and picked up by the pick-up roller 120. That is, the second sheet of the paper (P) is not picked up together with the uppermost sheet by a frictional force exerted on the second sheet by the uppermost sheet since the finger member grasps the second sheet with a grasping force larger than the frictional force. Since the finger member grasps the leading end of the paper (P), the paper (P) may be curled. Therefore, the shape and size of the finger member is properly designed to restrict the curling of the paper (P) to a predetermined level, to substantially prevent paper folding and paper jams.

When the pick-up roller 120 rotates and makes contact with the paper (P) at the large radial portion, the paper (P) and the knock-up plate 320 biased by the knock-up springs 328 are rotated downward and at the same time the paper (P) is picked up. As the pick-up roller 120 further rotates, the large radial portion of the pick-up roller 120 departs away from the paper (P) and the small radial portion of the pick-up roller 120 faces the paper (P). Then, the knock-up plate 320 is rotated upward to a predetermined height for picking up of the next sheet of the paper (P). Although the number of the sheets of paper (P) loaded in the paper cassette 110 is reduced, the height of the top of paper (P) can be kept at a constant level since the knock-up plate 320 is correspondingly rotated up. Therefore, the knock-up plate 320 is pushed down by the large radial portion of the pick-up roller 120 by a constant angle regardless of the amount of the paper (P) loaded on the knock-up plate 320. The finger member (not shown) or an additional stopping member restricts the height of the top of the paper (P) to a predetermined level.

Referring again to FIG. 4, a paper separating member 321 is provided such that two or more sheets of paper cannot be fed at the same time when a few sheets (for example, two sheets) of paper are loaded in the paper cassette 110. The frictional force between the paper separating member 320 and a sheet of paper (P) placed on the paper separating member 320 is larger than that between the uppermost sheet of paper and a sheet of paper placed immediately under the uppermost sheet of paper, such that two or more sheet of paper cannot be fed at the same time. The paper separator 321 is formed of, for example, cork or rubber.

The side guides 330*a* and 330*b* are provided beside the knock-up plate 320 on the leading end 310 of the base frame 300 where sheets of paper (P) are picked up by the pick-up roller 120 toward the inside of the main body 101 of the image forming apparatus 100. The side guides 330*a* and 330*b* support both side edges of paper before the knock-up plate 320. The side guides 330*a* and 330*b* includes racks 333*a* and 333*b* formed with teeth. The base frame 300 includes a pinion 334 on a bottom surface that rotates in engagement with the racks 333*a* and 333*b*. The pinion 334 is covered with a pinion cover 335. The racks 333*a* and 333*b* move on guide rails 339 in positive and negative directions of the y-axis for movement to and away from both side edges of the paper. The side guides 330*a* and 330*b* are formed on left and right sides of the base frame 300 and are connected to each other by the racks 333*a* and 333*b* and the pinion 334 for interlocking motion. When one of the side guides 330*a* and 330*b* is moved toward one side of the paper, the other is also moved toward the other side of the paper in an interlocked manner. The side guides 330*a* and 330*b* include top guides 331*a* and 331*b* guiding left and right top edges of the paper toward the knock-up plate 320. The base plate 300 includes a slope guide 325 on a bottom surface between the knock-up plate 320 and the side guides 330*a* and 330*b*. After the paper (P) is guided by the side guides 330*a* and 330*b*, the bottom surface of the paper (P) is guided by the slope guide 325 at a predetermined angle toward the knock-up plate 320, such that the paper may be smoothly moved without interference.

A pawl 337 and a ratchet 338 are disposed between the side guide 330*b* and the base frame 300. The pawl 337 is formed on the side guide 330*b* and the ratchet 338 is formed on the bottom surface of the base frame 300. The pawl 337 is engaged with teeth of the ratchet 338. The combination of the pawl 337 and the ratchet 338 allows the side guides 330*a* and 330*b* to freely approach the side edges of paper but restricts receding movement of the side guides 330*a* and 330*b* away from the side edges of paper. The side guide 330 on which the pawl 337 is formed is provided with a pawl-releasing handle 332. The pawl 337 can be disengaged from the ratchet 338 by pressing the pawl-releasing handle 332 by hand. Once the pawl 337 is disengaged from the ratchet 338, the side guides 330*a* and 330*b* may freely slide away from the side edges of paper.

The second movable frame 500 includes a rear guide 530 supporting a rear edge of paper. Pawls 537 are formed on a bottom surface of the rear guide 530, and ratchets 538 are formed on a bottom surface of the second movable frame 500 at a portion facing the pawls 537. The pawls 537 can be disengaged from the ratchets 538 by pressing the pawl-releasing handle 532 by hand. The combination of the pawls 537 and the ratchets 538 allows the rear guide 530 to freely approach the rear edge of paper but restricts receding movement of the rear guide 530 away from the rear edge of paper.

As explained above, the first fixing holes 340*a* and 340*b* may be arranged in two positions along the sliding direction of the first movable frame 400 (the x-axis direction). The fixing holes 340*a* of the first fixing holes 340*a* and 340*b* are formed to such an extent that the first movable frame 400 may fully approach but does not make contact with the pinion 334 and the racks 333*a* and 333*b* of the side guides 330*a* and 330*b*. Therefore, the contracted position of the first movable frame 400 may maximally approach the leading end 310 of the base frame in the negative direction of the x-axis.

The fixing holes 340*b* of the first fixing holes 340*a* and 340*b* are formed in the trailing end 399 of the base frame 300, such that the expanded position of the first movable frame 400 may be maximally away from the base frame in the positive direction of the x-axis. Though not shown, the first fixing holes may be formed in at least three positions along the sliding direction of the first movable frame 400 to allow for three fixed positions of the movable frame 400. Thus, the first movable frame 400 may be fixed at an intermediate position, as well as the fully contracted position and the fully expanded position.

The second fixing holes 550*a* and 550*b* may be arranged in at two positions along the sliding direction of the second movable frame 500 (the x-axis direction). The fixing hole 550*b* of the second fixing holes 550*a* and 550*b* is formed at a leading end of the second movable frame 500 to expand the second movable frame 500 maximally away from the trailing ends of the base frame 300 and the first movable frame 400 in the positive direction of the x-axis. That is, when the second fixing hole 550*b* located at the leading end of the second movable frame 500 is coupled to the second fixing protrusion 450, the second movable frame 500 is fixed at a fully expanded position with respect to the first movable frame 400.

The fixing hole 550*a* of the second fixing holes 550*a* and 550*b* is formed at a trailing end of the second frame 500 in alignment with the fixing hole 550*b* in the positive direction of the x-axis, to contract the second movable frame 500 maximally in the negative direction of the x-axis. That is, when the second fixing hole 550*a* located at the trailing end of the second movable frame 500 is coupled to the second fixing protrusion 450, the second movable frame 500 is fixed at a fully contracted position with respect to the first movable frame 400. However, when the second fixing hole 550*a* is excessively away from the second fixing hole 550*b* in the positive direction of the x-axis, the second fixing hole 550*a* may be blocked by the rear guide 530. Therefore, the second fixing hole 550*a* may be formed on the trailing end of the second frame 500 at a proper position such that the second fixing hole 550*a* cannot be blocked by the rear guide 530 when the rear guide 530 is fully slid away from a trailing edge of the paper. Though not shown, the second fixing holes may be formed in at least three positions along the sliding direction of the second movable frame 500. Thus, the second movable frame 500 may be fixed at an intermediate position, as well as the fully contracted position and the fully expanded position, with respect to the first movable frame 400.

The second movable frame 500 includes a frame border portion 510 enclosing a trailing edge of the paper. Guide bosses 590 are formed on both sides of the frame border portion 510, and guide boss rails 390 are formed on both sides of the base frame 300 to receive the guide bosses 590. The combination of the guide bosses 590 and the guide boss rails 390 allows the second movable frame 500 to slide on the base frame 300 without lateral shaking.

The first and second movable frames 400 and 500 may be expanded by hand pressing the fixing protrusions 440 and 450 to release the fixing protrusions 440 and 450 from the fixing holes 340*a*, 340*b*, 550*a*, and 550*b*, and by pulling the first and second movable frames in the positive direction of the x-axis. The first and second movable frames 400 and 500 are elastically biased by an elastic unit in the expanding direction (the positive direction of the x-axis). The elastic unit allows the first and second movable frames 400 and 500 to be easily expanded with a smaller pulling force. In one exemplary embodiment, the elastic unit includes push bars 350 and elastic springs 358. The push bars 350 are formed on the base frame 300 for pushing the first and second movable frame 400 and 500 in the expanding direction. The elastic springs 358 are disposed between the push bars 350 and the base frame 300 to apply elastic forces to the push bars 350 in the positive direction of the x-axis. One end of the push bars 351 makes contact with push bar contacts 511 formed on the second movable frame 500. The push bar contacts 511 moves along guide rails 355 when the first and second movable frames 400 and 500 slide. The push bars 350 elastically push the push bar contacts 511. The push bars 350 elastically urge the second movable frame 500 and the first movable frame coupled to the second movable frame 500 in the expanding direction (the positive direction of the x-axis).

As mentioned above, in one exemplary embodiment of the present invention, the paper cassette 110 includes two movable frames, the first and second movable frames 400 and 500. The first and second movable frames 400 and 500 are slidably inserted in the base frame 300. The first and second movable frames 400 and 500 are slid to desired positions based on the size of paper to be loaded in the paper cassette 110, and the first and second movable frames 400 and 500 are fixed to the desired positions by the fixing unit. Each of the first and second movable frames 400 and 500 may be fixed to a desired position from among multiple positions. The first movable frame 400 is inserted in the base frame 300 and is capable of moving relative to the base frame 300. The second movable frame 500 is inserted in the first movable frame 400 and is capable of moving relative to the first movable frame 400. The base frame 300, the first movable frame 400, and the second movable frame 500 are assembled without interference with one another.

In one exemplary embodiment, the second movable frame 500 includes a second guide plate 560 extending from a center portion in the negative direction of the x-axis. The first movable frame 400 includes a guide rail plate 460 on a center portion to slidably receive the second guide plate 560. The second guide plate 560 slides on the guide rail plate 460 along guide rails 465 formed on the guide rail plate 460, allowing the first and second movable frame 400 and 500 to move relative to each other.

The base frame 300 includes a first slot portion 360 on a center portion. The guide rail plate 460 and the second guide plate 560 inserted in the guide rail plate 460 are slidably inserted in guide rails 365 formed in the first slot portion 360. The first slot portion 360 forms a sliding space for the assembly of the second guide plate 560 and the guide rail plate 460. Therefore, when the first movable frame 400 moves relative to the base frame 300, the base frame 300, the first movable frame 400, and the second movable frame 500 may be prevented from interfering with one another.

The first movable frame 400 includes first guide plates 470 that are respectively formed at left and right sides of the guide rail plate 460. The base frame 300 includes second slot portions 370 that are respectively formed at left and right sides of the first slot portion 360. The first guide plates 470 are slidably inserted in guide rails 375 formed in the second slot portions 370. The second slots 370 form sliding spaces for the first guide plates 470. Therefore, when the first and second movable frames 400 and 500 are both moved relative to the base frame 300, the base frame 300, the first movable frame 400, and the second movable member 500 may be prevented from interfering with one another. As explained above, the second movable frame 500 and the base frame 300 may include the guide bosses 590 and the guide boss rails 390, respectively, to couple the first and second movable frame 400 and 500 to the base frame 300 without lateral shaking.

An expanding motion of the paper cassette 110 is described in detail with respect to FIGS. 5 through 8. Referring to FIG. 5, the paper cassette 110 is fully contracted. The first movable frame 400 is fixed in a fully contracted position where the first fixing protrusions 440 are coupled to the first fixing holes 340*a* adjacent to the racks 333*a* and 333*b* and the pinion 334. The second movable frame 500 is also fixed in a fully contracted position where the second fixing protrusion 450 of the first movable member 400 is coupled to the second fixing hole 550*a* formed in the trailing end of the second movable frame 500. A distance Lb from the leading end 310 of the base frame 300 to the trailing end 399 of the base frame 300 is substantially equal to a distance L1 from the leading end 310 to the trailing end of the first movable frame 400, and substantially equal to a distance L2 from the leading end 310 to the trailing end of the second movable frame 500. For example, when A6, A5, or B5 size paper sheets are loaded in the paper cassette 110, the side guides 330*a* and 330*b* and the rear guide 530 are adjusted to firmly support both side edges and trailing edges of the paper sheets.

Referring to FIG. 6, the second movable frame 500 is fixed in the contracted position, and the first movable frame 400 is expanded with respect to the base frame 300. When the first movable frame 400 slides in an expanding direction (the positive direction of the x-axis), the first fixing protrusions 440 are coupled to the fixing holes 340*b* formed in the trailing end 399 of the base frame 300. Because the second movable frame 500 is fixed in the contracted position, the second protrusion 450 is still coupled to the second fixing hole 550*a* formed in the trailing end of the second movable frame 500. The distance L1 from the leading end 310 of the base frame 300 to the trailing end of the first movable frame 400 is substantially equal to the distance L2 from the leading end 310 of the base frame 300 to the trailing end of the second movable frame 500. The distances L1 and L2 are larger than the distance Lb from the leading end 310 of the base frame 300 to the trailing end 399 of the base frame 300. For example, when A4 size paper sheets are loaded in the paper cassette 110, the side guides 330*a* and 330*b* and the rear guide 530 are adjusted to securely support both side edges and trailing edges of the loaded paper sheets.

Referring to FIG. 7, the first movable frame 400 is fixed in the contracted position, and the second movable frame 500 is fixed in an expanded position. Because the first movable frame 400 is fixed in the contracted position, the first fixing protrusions 440 are coupled to the first fixing holes 340*a* adjacent to the racks 333*a* and 333*b* and the pinion 334. However, because the second movable frame 500 is fixed in the expanded position, the second protrusion 450 is coupled to the second fixing hole 550*b* formed in the leading end of the second movable frame 500. The distance L1 from the leading end 310 of the base frame 300 to the trailing end of the first movable frame 400 is substantially equal to the distance Lb from the leading end 310 of the base frame 300 to the trailing end 399 of the base frame 300. The distance L2 from the leading end 310 of the base frame 300 to the trailing end of the second movable frame 500 is larger than the distances L1 and Lb. For example, when letter size paper sheets smaller than A4 size but larger than B5 size are loaded in the paper cassette 110, the side guides 330*a* and 330*b* and the rear guide 530 are adjusted to securely support both side edges and trailing edges of the loaded paper sheets.

Referring to FIG. 8, the first and second movable frame 400 and 500 are both fixed in the expanded positions. When the first movable frame 400 slides in the expanding direction (the positive direction of the x-axis), the first fixing protrusions 440 couples to the first fixing holes 340*b* formed in the trailing end 399 of the base frame 300. When the second movable frame 500 slides relative to the first movable frame 400 in the expanding direction (the positive direction of the x-axis), the second fixing protrusion 450 couples to the second fixing hole 550*b* formed in the leading end of the second movable frame 500. The distance L1 from the leading end 310 of the base frame 300 to the trailing end of the first movable frame 400 is larger than the distance Lb from the leading end 310 of the base frame 300 to the trailing end 399 of the base frame 300. The distance L2 from the leading end 310 of the base frame 300 to the trailing end of the second movable frame 500 is larger than the distance L1 from the leading end 310 of the base frame 300 to the trailing end of the first movable frame 400. For example, when legal size paper sheets larger than A4 size are loaded in the paper cassette 110, the side guides 330*a* and 330*b* and the rear guide 530 are adjusted to securely support both side edges and trailing edges of the loaded paper sheets.

As described above, the paper cassette of the present invention may be contractible and expandable by sliding the movable frames relative to the base frame and then coupling the fixing protrusions to desired fixing holes. Therefore, paper sheets having various sizes may be loaded in the paper cassette, and the size of the image forming apparatus and the packing size of the image forming apparatus may be reduced without limitation on the size of the paper cassette.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A paper cassette, comprising:

a base frame adapted to be detachably coupled to a main body of an image forming apparatus and receiving a leading end of paper;

a movable frame inserted in the base frame and slidable on the base frame, the movable frame receiving a trailing end of the paper, the movable frame including a first movable frame slidably inserted in the base frame and a second movable frame slidably inserted in the first movable frame; and a fixing unit fixing the movable frame at a position selected from a plurality of preset fixing positions, the fixing unit having a plurality of fixing holes and a plurality of fixing protrusions respectively formed on the bottom surfaces of the base frame and the movable frames for being coupled with each other, the fixing protrusions being elastically coupled to the fixing holes and being releasable from the fixing holes by being depressed, wherein the fixing protrusions include a first fixing protrusion and a second fixing protrusion that are formed on the first movable frame, the first fixing protrusion determining a fixing position of the first movable frame, the second fixing protrusion determining a fixing position of the second movable frame relative to the first movable frame, wherein the first fixing protrusions are formed on both sides of the first movable frame in a symmetric manner and are released from the fixing holes when depressed, and the second fixing protrusion is formed on a center portion of the first movable frame and released from the fixing hole when depressed, and wherein the paper cassette is adjustable by a sliding motion of the movable frame by selectively changing the coupling positions between the fixing holes and the fixing protrusions.

2. The paper cassette of claim 1, wherein the fixing holes comprise a plurality of first fixing holes formed in the bottom surface of the base frame and arranged in a sliding direction of the movable frames; and a plurality of second fixing holes formed in a bottom surface of the second movable frame and arranged in the sliding direction of the movable frames, wherein when the first movable frame slides, the first fixing protrusion moves and elastically couples to one of the first fixing holes, and when the second movable frame slides, the second fixing holes move and one of the second fixing holes elastically couples to the second protrusion.

3. The paper cassette of claim 2, wherein the first fixing holes are formed along the sliding direction at a position allowing the first movable frame to be fixed in a contracted state, and at a position allowing the first movable frame to be fixed in an expanded state, and the second fixing holes are formed along the sliding direction at a position allowing the second movable frame to be fixed in a contracted state relative to the first movable frame, and at a position allowing the second movable frame to be fixed in an expanded state relative to the first movable frame.

4. The paper cassette of claim 3, wherein the base frame comprises a knock-up plate hinged on a leading end of the base frame for elastically supporting the leading end of the paper; and a pair of side guides connected to each other by a rack and a pinion for interlocking with each other, the side guides supporting both side edges of the paper in front of the knock-up plate, wherein the first fixing holes are formed in the bottom surface of the base frame at a trailing end of the base frame and at a predetermined position allowing the first movable frame to be close to the rack and the pinion but not in contact with the rack and the pinion.

5. The paper cassette of claim 4, wherein the side guides comprise a pawl, and the base frame further comprises a ratchet on a bottom surface that engages with the pawl, the side guides being freely movable in a direction approaching the side edges of the paper but not freely movable in an opposite direction to the approaching direction.

6. The paper cassette of claim 3, wherein the second movable frame comprises a rear guide supporting the trailing end of the paper, wherein the second fixing holes are formed at a leading end of the second movable frame, and at a position where the second fixing hole is not blocked by the rear guide when the rear guide is maximally moved away from the trailing end of the paper.

7. The paper cassette of claim 6, wherein the rear guide comprises a pawl, and the second movable frame further comprises a ratchet on a bottom surface that engages with the pawl, the rear guide being freely movable in a direction approaching the trailing end of the paper but not freely movable in an opposite direction to the approaching direction.

8. The paper cassette of claim 1, wherein the second movable frame comprises a frame border portion enclosing the trailing end of the paper; and the base frame comprises guide boss rails on both sides for receiving guide bosses formed on both sides of the frame border portion, the guide bosses being movable on the guide rails.

9. The paper cassette of claim 1, further comprising an elastic unit urging the movable frame in an expanding direction.

10. The paper cassette of claim 9, wherein the elastic unit is formed on the base frame, the elastic unit comprising a push bar elastically pushing the movable frame in the expanding direction and an elastic spring applying an elastic force to the push bar.

11. A paper cassette, comprising:

a base frame adapted to be detachably coupled to a main body of an image forming apparatus and receiving a leading end of paper; and a first movable frame and a second movable frame that are slidably assembled in the base frame for receiving a trailing end of the paper, the first and second movable frames being selectively fixed at a position taken from multiple fixing positions, wherein the first movable frame is inserted in the base frame, and the second movable frame is inserted in the first movable frame, the second movable frame including a second guide plate protruded on a center portion and the first movable frame including a guide rail plate in which the second guide plate is slidably inserted, and the base frame including a first slot portion forming a sliding space for the guide rail plate and the second guide plate inserted in the guide rail plate, and the base frame, the first movable frame, and the second movable frame are prevented from interfering with each other when the first and second movable frames slide.

12. The paper cassette of claim 11, wherein the first movable frame further comprises first guide plates formed at left and right sides of the guide rail plate, and the base frame further comprises second slot portions formed at left and right sides of the first slot portion for slidably receiving the first guide plates.

13. The paper cassette of claim 12, wherein the second movable frame further comprises a frame border portion enclosing a trailing end of the paper, and the base frame further comprises guide boss rails on both sides for receiving guide bosses formed on both sides of the frame border portion, the guide bosses being movable on the guide rails.

14. An image forming apparatus, comprising:

a main body; and a paper cassette adapted to receive paper, the paper cassette including a base frame detachably coupled to the main body of the image forming apparatus and receiving a leading end of the paper;

a movable frame inserted in the base frame and slidable on the base frame, the movable frame receiving a trailing end of the paper, the movable frame including a first movable frame slidably inserted in the base frame and a second movable frame slidably inserted in the first movable frame; and a fixing unit fixing the movable frame at a position selected from a plurality of preset fixing positions, the fixing unit having a plurality of fixing holes and a plurality of fixing protrusions that are respectively formed on the bottom surfaces of the base frame and the movable frames for being coupled with each other, the fixing protrusions being elastically coupled to the fixing holes and being releasable from the fixing holes by being depressed, wherein the fixing protrusions include a first fixing protrusion and a second fixing protrusion that are formed on the first movable frame, the first fixing protrusion determining a fixing position of the first movable frame, the second fixing protrusion determining a fixing position of the second movable frame relative to the first movable frame, wherein the first fixing protrusions are formed on both sides of the first movable frame in a symmetric manner and are released from the fixing holes when depressed, and the second fixing protrusion is formed on a center portion of the first movable frame and released from the fixing hole when depressed, and wherein the paper cassette is adjustable by a sliding motion of the movable frame by selectively changing the coupling positions between the fixing holes and the fixing protrusions.

15. The image forming apparatus of claim 14, wherein the fixing protrusions are released from the fixing holes by being manually depressed.

16. The image forming apparatus of claim 14, wherein the fixing holes comprise a plurality of first fixing holes formed in the bottom surface of the base frame and arranged in a sliding direction of the movable frames; and a plurality of second fixing holes formed in a bottom surface of the second movable frame and arranged in the sliding direction of the movable frames, wherein when the first movable frame slides, the first fixing protrusion moves and elastically couples to one of the first fixing holes, and when the second movable frame slides, the second fixing holes move and one of the second fixing holes elastically couples to the second protrusion.

17. The image forming apparatus of claim 16, wherein the first fixing holes are formed along the sliding direction at a position allowing the first movable frame to be fixed in a contracted state, and at a position allowing the first movable frame to be fixed in an expanded state, and the second fixing holes are formed along the sliding direction at a position allowing the second movable frame to be fixed in a contracted state relative to the first movable frame, and at a position allowing the second movable frame to be fixed in an expanded state relative to the first movable frame.

18. The image forming apparatus of claim 17, wherein the base frame comprises a knock-up plate hinged on a leading end of the base frame for elastically supporting the leading end of the paper; and a pair of side guides connected to each other by a rack and a pinion for interlocking with each other, the side guides supporting both side edges of the paper in front of the knock-up plate, wherein the first fixing holes are formed in the bottom surface of the base frame at a trailing end of the base frame and at a predetermined position allowing the first movable frame to be close to the rack and the pinion but not in contact with the rack and the pinion.

19. The image forming apparatus of claim 18, wherein the side guides comprise a pawl, and the base frame further comprises a ratchet on a bottom surface that engages with the pawl, the side guides being freely movable in a direction approaching the side edges of the paper but not freely movable in an opposite direction to the approaching direction.

20. The image forming apparatus of claim 17, wherein the second movable frame comprises a rear guide supporting the trailing end of the paper, wherein the second fixing holes are formed at a leading end of the second movable frame, and at a position where the second fixing hole is not blocked by the rear guide when the rear guide is maximally moved away from the trailing end of the paper.

21. The image forming apparatus of claim 20, wherein the rear guide comprises a pawl, and the second movable frame further comprises a ratchet on a bottom surface that engages with the pawl, the rear guide being freely movable in a direction approaching the trailing end of the paper but not freely movable in an opposite direction to the approaching direction.

22. The image forming apparatus of claim 14, wherein the second movable frame comprises a frame border portion enclosing the trailing end of the paper; and the base frame comprises guide boss rails on both sides for receiving guide bosses formed on both sides of the frame border portion, the guide bosses being movable on the guide rails.

23. The image forming apparatus of claim 14, further comprising an elastic unit urging the movable frame in an expanding direction.

24. The image forming apparatus of claim 23, wherein the elastic unit is formed on the base frame, the elastic unit comprising a push bar elastically pushing the movable frame in the expanding direction and an elastic spring applying an elastic force to the push bar.

25. The image forming apparatus of claim 14, wherein the movable frame is slidable on the base frame by hand.

26. The image forming apparatus of claim 14, wherein the first fixing protrusions and the second fixing protrusion are releasable from their respective fixing holes when depressed by hand.

* * * * *

UNITED STATES PATENT AND TRADEMARK OFFICE

CERTIFICATE OF CORRECTION

PATENT NO. : 7,668,502 B2
APPLICATION NO. : 11/582997
DATED : February 23, 2010
INVENTOR(S) : Gyeong-ho Park It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 627 days.

Signed and Sealed this

Twenty-eighth Day of December, 2010

David J. Kappos

David J. Kappos
*Director of the United States Patent and Trademark Office*